United States Patent [19]

Heck

[11] 4,345,803

[45] Aug. 24, 1982

[54] WORK STATION DESK

[76] Inventor: Peter J. Heck, 2801 Maple St., Michigan City, Ind. 46360

[21] Appl. No.: 158,283

[22] Filed: Jun. 10, 1980

[51] Int. Cl.[3] ..... A47B 21/00; A47B 13/08

[52] U.S. Cl. ..... 312/194; 312/196; 312/208; 312/239; 108/90

[58] Field of Search ..... 312/194, 195, 196, 239, 312/208; 108/64, 90, 96; D6/162

[56] References Cited

U.S. PATENT DOCUMENTS

| | | | |
|---|---|---|---|
| D. 159,663 | 8/1950 | Pattishall | D6/162 |
| D. 239,227 | 3/1976 | Pohlheim | D6/162 |
| 670,370 | 3/1901 | Dewhurst | 312/208 |
| 744,888 | 11/1903 | Widman et al. | 312/239 |
| 951,506 | 3/1910 | Meyer | 312/239 |
| 1,293,952 | 2/1919 | Shirley | 312/239 |
| 1,308,441 | 7/1919 | Myers | 312/239 |
| 1,358,033 | 11/1920 | Smith | 312/208 |
| 1,377,767 | 5/1921 | Falls | 312/196 |
| 1,700,201 | 1/1929 | Langford et al. | 312/196 |
| 1,849,726 | 3/1932 | Reed | 312/194 |
| 2,129,384 | 9/1938 | Ralston | 312/208 |
| 2,219,762 | 10/1940 | Burdick et al. | 312/208 |
| 2,242,745 | 5/1941 | Coxhead | 312/208 |
| 2,386,092 | 10/1945 | Cornish | 312/239 |
| 2,533,155 | 12/1950 | Von Hacht | 312/194 |
| 2,860,404 | 11/1958 | Alden | 312/257 R |
| 3,533,362 | 10/1970 | Thompson | 312/195 |
| 3,696,760 | 10/1972 | Riley | 312/239 |
| 3,834,325 | 9/1974 | DeWilde | 108/96 |
| 4,080,022 | 3/1978 | Canfield et al. | 312/239 |

FOREIGN PATENT DOCUMENTS

| | | | |
|---|---|---|---|
| 1330542 | 5/1963 | France | 312/194 |
| 591288 | 8/1947 | United Kingdom | 312/194 |

*Primary Examiner*—Victor N. Sakran

[57] ABSTRACT

Work station angular desk for an office machine, containing a center section having a substantially rectangular center work surface with a straight front access edge sufficiently wide relative to a person to provide an unobstructed work station area thereat and to accommodate an office machine, e.g. computer, therein, a pair of opposed diverging side sections angularly disposed to each other and to the center section, each side section having a substantially triangular side work surface adjacent the center surface, a recess in the center surface extending to the front edge and providing a lower level recess area, filler members removably inserted in the recess to modify the recess area for accommodating an office machine in the work station area, and mounting structure supporting the sections as a free standing desk sufficiently wide at the center surface to provide such unobstructed work station area for a person situated at the front edge and vicinally between the adjacent confines of the side surfaces and to accommodate an office machine in the work station area at such recess; and alternative form angular desk, in which the recess is omitted, the center and side sections are separate from each other and correspondingly the side surfaces are separate from and adjacent the center surface, and the mounting structure interconnects and supports the sections as such a desk which has a substantially continuous and uniform level composite work surface and which is sufficiently wide at the center surface for the stated purposes.

20 Claims, 9 Drawing Figures

WORK STATION DESK

The present invention relates to a work station free standing desk for an office machine such as a computer, and more particularly to such a desk having means including a front access edge of sufficient width relative to the width of an office machine operator situated thereat to provide an unobstructed work station area and to accommodate an office machine.

Desks of various types having special features for adapting them to particular office routines are known. For instance, U.S. Pat. No. 2,219,762 (Burdick et al) shows a desk with a typewriter platform at one side thereof below the level of the top surface of the desk at the other side thereof, in conjunction with a shallow vertical cabinet on the rear outer wall of the desk having a slot for feeding special paper to the typewriter on the lower level platform of the desk, in such manner that the rear upper corner of the desk serves as an intermediately positioned guide for the paper feed to an appropriate level at the top of the typewriter because the typewriter is situated at the lower level platform and not at the full height of the desk top surface.

U.S. Pat. No. 1,358,033 (Smith) shows a support for a typewriter having a rear paper feed from a pair of superimposed inclined drawers within the support, in which the upper drawer edge is provided with a guide for the paper feed from the lower drawer similar to the rear upper corner guide in the lower level typewriter platform desk in said U.S. Pat. No. 2,219,762 (Burdick et al).

U.S. Pat. No. 1,849,726 (Reed) shows a table with an L-shaped top containing an open corner well for a punch card indexing machine and provided with an opening for passage of punched portions of the punch cards into a drawer therebelow for collection.

U.S. Pat. No. 670,370 (Dewhurst) shows a table containing a partially permanently covered central well or recess for a typewriter and provided with a pull-out shelf to extend the typewriter forwardly outwardly from the table recess for unobstructed access and a hinged partial cover to enclose completely the typewriter when the pull-out shelf is returned to full inward position within the partially permanently covered portion of the recess.

U.S. Pat. No. 1,377,767 (Falls) shows a recessed desk top with a hinged top cover and separate hinged side cover for compositely enclosing and storing a typewriter on its own separate table standing on the floor in an open well within the confines of the desk when not in use.

U.S. Pat. No. 2,129,384 (Ralston) shows a work table with a more or less L-shaped top containing an open corner well or recess for holding an upwardly tiltable horizontally hinged shelf for a calculating machine and a horizontally swingable vertically hinged platform frame for carrying worksheets which swings about a hinge pivot located on the front edge of the desk more or less midway between the lateral sides of the desk.

U.S. Pat. No. 1,293,952 (Shirley) shows a U-shaped confined front curved and rear truncated triangle edge configuration desk, including a more or less trapezoid shaped hinged top center portion having the shorter curved edge of the trapezoid adjacent the confined front of the desk where the user is seated and the longer hinged straight edge of the trapezoid at the rear of the desk, one more or less front curved edge and rear angular edge oblong shaped hinged top side portion having the hinged edge thereof at the rear of the desk and another more or less front curved edge and rear angular edge oblong shaped stationary top side portion opposite the hinged top side portion, both side portions being complemental to the trapezoid shaped center portion to complete the U-shaped confined front curved desk.

U.S. Pat. No. 2,386,092 (Cornish) shows a hexagonally shaped desk top on a pair of outwardly diverging spaced apart end pedestals of generally rectangular shape, thereby leaving some room, although confining in nature, beneath the desk at both the front and back sides thereof, i.e. where the top overlaps the end pedestals, for a user to sit.

U.S. Pat. No. 4,080,022 (Canfield et al) shows a high solid volume multiple station service counter for use by persons standing thereat and of more or less zig-zag angular or U-shaped curved orientation which is provided with a computer well in the top surface of the counter behind an upstanding divider.

U.S. Design No. 159,663 (Pattishall) shows a table having a pentagonally shaped top connected to a lower level side wing and supported on one side by a pedestal formed of a set of drawers and on the other side and rear by vertical walls.

U.S. Design No. 239,227 (Pohlheim) shows a desk formed of a pair of separate elongated rectangular wing portions angularly disposed to each other and interconnected by a floating triangular curved fan-like horizontal member having the apex portion thereof at the confined front side of the desk similar to the U-shaped arrangement in said U.S. Pat. No. 1,293,952 (Shirley).

These and other known desk constructions do not provide simple and inexpensive solutions to adequate unobstructed access of an office machine operator to an office machine at the work station area of such a desk or to convenient modification of the work station area to conform the same to a given office machine such as a computer thereat, especially where the desk is to be located in a confined space in a room and the office machine operator is normally intended to spend his working day at such desk.

It is among the objects and advantages of the present invention to overcome the drawbacks and deficiencies of the prior art, and to provide a work station free standing desk for an office machine such as a computer, having means including a front access edge of sufficient width relative to the width of an office machine operator situated thereat to permit an unobstructed work station area to be achieved and also to permit the versatile accommodation of an office machine in such work station area, and especially to provide such a desk in the form of an angular desk, and more particularly a free standing raised platform desk in which the mounting legs are situated relatively remote from the immediate confines of the front access edge.

It is among the additional objects and advantages of the present invention to provide a desk of the foregoing type which in accordance with one feature thereof contemplates means for modifying the work station area to conform the same to the conformity of a given office machine to be used thereat and/or individual office machine operator situated at such office machine.

It is among the further objects and advantages of the present invention to provide a desk of such foregoing type which in accordance with another feature thereof contemplates essentially separate central and opposed side work surface sections interconnected and supported in the form of a free standing angular desk having a substantially continuous and uniform level composite work surface and a sufficient width at the center section to permit such unobstructed work station area to be achieved for an office machine operator situated at the front access edge and vicinally between the adjacent confines of the side sections and also to permit accommodation of such an office machine in the work station area thereat.

It is among the still further objects and advantages of the present invention to provide a desk of the foregoing type which is simple, space-saving and confined shaped space-adaptable in design and construction, inexpensive to produce from readily available materials with minimum effort and wastage, capable of ready disassembly and reassembly, and robust and durable in use without aggravating the normal strain on the office machine operator situated at the desk for prolonged periods of time.

Other and further objects and advantages of the present invention will become apparent from a study of the within specification and accompanying drawings, in which.

Figure 1:
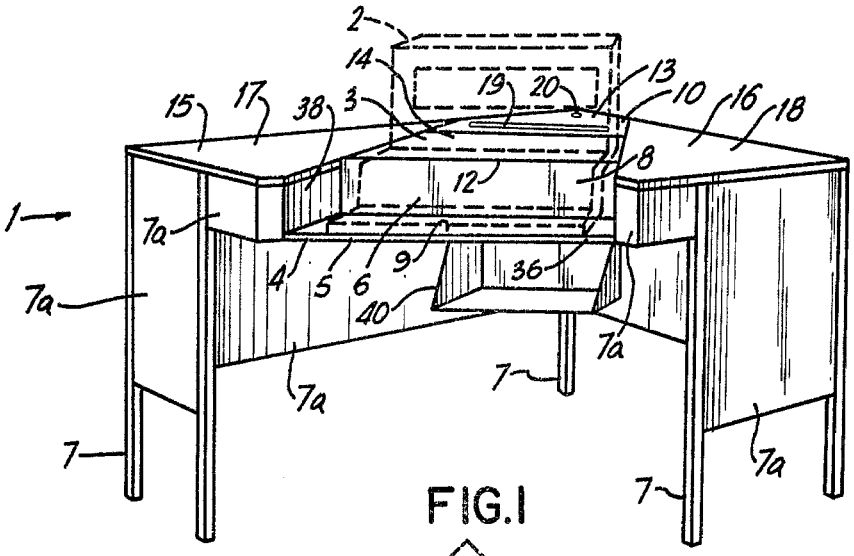
FIG. 1 is a schematic perspective view of a recess-containing work station desk for an office machine such as a computer according to one embodiment of the present invention showing an office machine accommodating work station area having a filler block member modifiable recess for conforming the work station area to the conformity of a given office machine being used thereat.

In accordance with one embodiment of the present invention, a recess-containing work station desk for an office machine such as a computer is contemplated which comprises a work surface portion provided along one side thereof constituted as a front side with a front access edge of sufficient width relative to the width of an office machine operator to provide an unobstructed work station area thereat and to accommodate an office machine therein, and mounting means including legs relatively remote from the immediate confines of the front access edge and supporting the work surface portion in the form of a desk.

Advantageously, an office machine accommodating depression recess is defined intermediately in the work surface portion which extends forwardly peripherally to the front access edge to provide a lower level open recess area thereat relative to the level of the surrounding lateral and rearward remainder of the work surface portion. Consonant therewith, cooperating compositely complemental structurally supporting depression recess modifying filler means, such as at least two interchangeable block members, are provided for removable insertion in the recess and cooperating therewith to modify the extent and configuration of the open recess area thereat in conformity with the corresponding extent and configuration of an office machine being accommodated in the work station area.

Preferably, the modifying filler means may include in tandem a rear block member and a front block member which together completely fill the recess to provide a substantially continuous and uniform level composite work surface at the work surface portion.

Naturally, the height or level of the normal or upper level work surface portion, i.e. at standard desk height, of the depression recess and especially the lower level open recess area, and of the legs for mounting the work surface portion on the floor, are interrelated selectively so as to provide inherently a recess area which may be modified in height by the filler means relative to the floor, the chair of the office machine operator, the office machine and the work surface portion, for concordant optimum accommodating effect in the context of the dimensions of the desk in question.

Thus, the recess may be substantially coextensive in width to the width of the front access edge, the work surface portion may comprise a selectively raised platform, and the mounting means may include legs depending from the peripheral portions of the work surface portion relatively remote from the immediate confines of the front access edge and supporting the work surface portion in the form of a free standing raised platform desk.

More particularly, such desk may be preferably in the form of a recess-containing work station angular desk comprising a center section having a substantially rectangular center work surface portion provided along one side thereof constituted as the front side with a substantially straight front access edge of sufficient width relative to the width of an office machine operator to provide an unobstructed work station area thereat and also to accommodate the office machine therein, and a pair of opposed diverging side sections angularly disposed to each other and to the center section, with each side section having a corresponding substantially triangular side work surface portion adjacent to the center work surface portion.

Suitably, a selectively shaped and sized office machine accommodating depression recess is defined intermediately in the desk in the center work surface portion and which extends forwardly peripherally to the front access edge to provide a lower level open recess area thereat relative to the level of the rearward remainder of the center work surface portion and the lateral remainder of the desk. Correspondingly, cooperating compositely complemental selectively shaped and sized structurally supporting depression recess modifying filler means, such as interchangeable block members as noted above, are provided for removable insertion in the recess and cooperating therewith to modify the extent and configuration of the open recess area thereat in conformity with the corresponding extent and configuration of the office machine being accommodated in the work station area.

In this regard, the mounting means support the center section and side sections in the form of a free standing angular desk correspondingly having such sufficient width at the center work surface portion to provide the stated unobstructed work station area for the office machine operator situated at the front access edge and vicinally between the adjacent confines of the side work surfaces of the opposed diverging side sections angularly disposed to the center section and also to accommodate the office machine in the work station area at such recess.

Preferably, a paper feed slot may be provided in the center work surface portion, e.g. rearwardly of the recess, and having a sufficient slot length to accommodate the feeding of office machine paper between a location in the center section below the center work surface portion and an office machine location on the center work surface portion.

In particular, the side sections may be angularly disposed at an angle of about 90 degrees to each other and correspondingly at an angle of about 45 degrees to the center section.

The three sections may favorably comprise raised platforms and the mounting means may include legs depending from peripheral portions of the center section and side sections preferably substantially remote from the immediate confines of the front access edge.

Optionally, an extension wing may be outwardly provided on at least one of the side sections to form a lateral continuation thereof in an angular direction away from the center work surface portion.

Significantly, the recess is desirably substantially coextensive in width to the width of the front access edge and center work surface portion. The filler means, when completely operatively occupying the recess, advantageously completely fill the recess to provide a substantially continuous and uniform level composite work surface at the work surface portion.

With respect to a specific constructional aspect of this recess-containing angular desk embodiment, the side sections may be separate from each other and from the center section and removably interconnected by the mounting means.

Accordingly, the center work surface portion rearwardly of the recess may be provided with a pair of substantially parallel side abutment internal upper edges, an intermediate internal upper edge facing the front access edge and defining the upper level rearward limit of the recess, and a substantially converging composite rear corner external or peripheral upper edge opposite to and remote from the front access edge. In turn, the center work surface portion lower level recess area may be provided with a corresponding pair of substantially parallel recess area side abutment internal lower edges and a recess area intermediate internal lower edge defining the lower level rearward limit of the recess area, with the front access edge defining the forward limit of the recess area.

In complemental relation thereto, each side work surface portion may be correspondingly provided with an angularly disposed end abutment internal upper edge in substantially coextensive facing relation to the adjacent side abutment internal upper edge of the center work surface portion and in substantially coextensive overlying facing relation to the adjacent recess area side abutment internal lower edge, as well as with substantially parallel front and rear angularly disposed external or peripheral upper edges extending from the end abutment internal upper edge in an angular direction away from the center work surface portion and a free end external or peripheral upper edge remote from the center work surface portion.

In accordance with an alternative embodiment of the present invention, a tripartite recess-free work station angular desk for an office machine such as a computer is contemplated which comprises an individual center section having a substantially rectangular individual center work surface portion provided along one side thereof constituted as a front side with a substantially straight front access edge of sufficient width relative to the width of an office machine operator to provide an unobstructed work station area thereat and also to accommodate an office machine therein, as well as a pair of opposed diverging individual side sections separate from and angularly disposed to each other and to the center section. Each side section has a corresponding substantially triangular individual side work surface portion separate from and adjacent to the center work surface portion.

The mounting means for the recess-free angular desk according to this alternative embodiment of the present invention advantageously interconnect and support the central section and side sections in the form of a tripartite free standing angular desk having a substantially continuous and uniform level composite work surface and correspondingly having a sufficient width at the center work surface portion to provide such unobstructed work station area for the office machine operator situated at the front access edge and vicinally between the adjacent confines of the side work surface portions of the opposed diverging side sections angularly disposed to the center section and also to accommodate the office machine in the work station area.

Similarly, a paper feed slot may also be provided in the center work surface portion having a sufficient slot length to accommodate the feeding of office machine paper between a location in the center section below the center work surface portion and an office machine location on the center work surface portion.

Also, the separate side sections may be preferably likewise angularly disposed at an angle of about 90 degrees to each other and correspondingly at an angle of about 45 degrees to the center section.

The three separate sections may suitably comprise individual raised platforms and the mounting means may accordingly include legs depending from peripheral portions of the center section and side sections preferably relatively remote from the immediate confines of the front access edge and supporting the sections in the form of a free standing tripartite raised platform desk.

As desired, an extension wing may be optionally outwardly provided on at least one of the separate side sections to form a lateral continuation thereof in an angular direction away from the center work surface portion.

With respect to a specific constructional aspect of this recess-free angular desk alternative embodiment the three sections may be advantageously removably interconnected by the mounting means.

Accordingly, the center work surface portion may be provided with a pair of substantially parallel side abutment internal edges and a substantially converging composite rear corner external or peripheral edge opposite to and remote from the front access edge.

In complemental relation thereto, each side work surface portion may be correspondingly provided with an angularly disposed end abutment internal edge in substantially coextensive facing relation to the adjacent side abutment internal edge of the center work surface portion, as well as with substantially parallel front and rear angularly disposed external or peripheral edges extending from the end abutment internal edge in an angular direction away from the center work surface portion and a free end external or peripheral edge remote from the center work surface portion.

Figure 2:
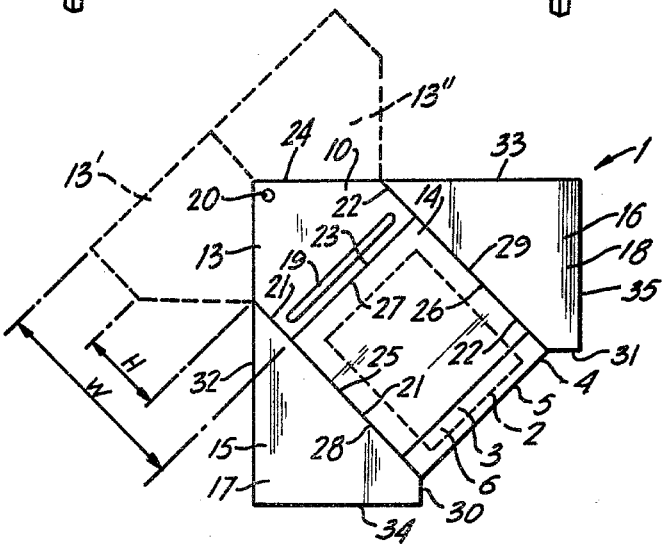
FIG. 2 is a schematic top view of the desk shown in FIG. 1.
Figure 3:
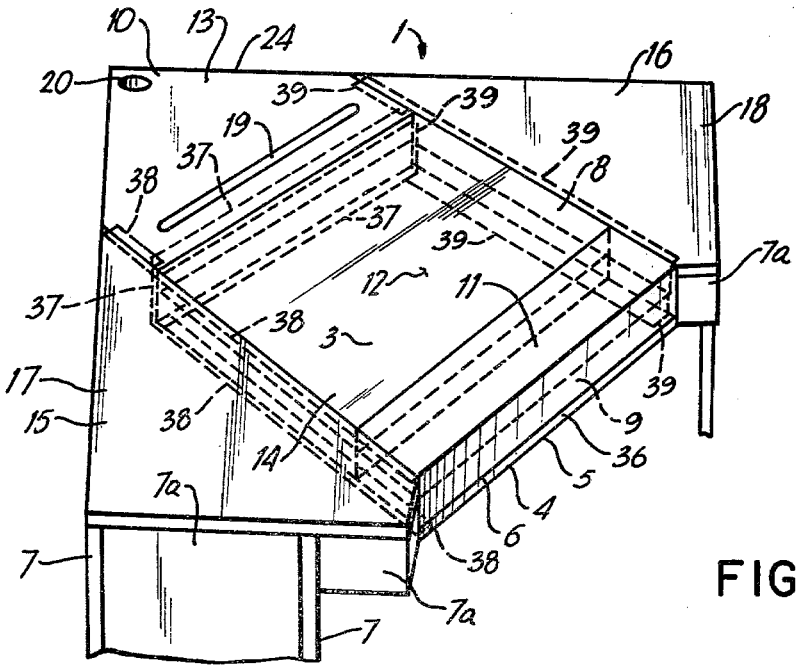
FIG. 3 is a schematic perspective view of the desk shown in FIG. 1 and illustrating the manner in which the interchangeable filler block members may be arranged to modify the recess.

Referring to the drawings, and initially to FIGS. 1 to 3, a recess-containing work station desk 1 for an office machine such as a computer, schematically shown at 2, according to one embodiment of the present invention is shown, comprising a work surface portion 3 provided along its front side 4 with a substantially straight front access edge 5.

Front edge 5 is of sufficient linear width relative to the width, e.g. from shoulder to shoulder, of an office machine operator (not shown) seated at the desk 1 to provide an unobstructed work station area 6 thereat and also to accommodate the office machine 2 therein.

Mounting means including legs 7 support the work surface portion 3 in the form of desk 1. Desirably, vertical walls *7a* may be provided to contribute vertical and lateral support between the legs 7 and a hollow box like structural configuration type mounting means for the desk.

It is to be understood that while the legs 7 are illustrated as some what remote from the front access edges of the desk, the legs 7 or equivalent leg panels, may be disposed in a more forward position without departing from the spirit of the invention.

A selectively shaped and sized office machine accommodating depression recess 8 is defined intermediately in the work surface portion 3 which extends forwardly peripherally to the front access edge 5 to provide a lower level open recess area 9 thereat relative to the upper normal level of the surrounding lateral and rearward remainder 10 of the work surface portion 3. Cooperating compositely complemental selectively shaped and sized structurally supporting, or office machine load-bearing, depression recess modifying filler means such as at least two interchangeable front and rear block members 11 and 12 (FIG. 3) are provided for removable insertion in the recess 8 and cooperating therewith to modify the extent, level and configuration of the open recess area 9 thereat in conformity with the corresponding extent, level and configuration of the office machine 2 being accommodated in the work station area 6.

When both of the block members 11 and 12 are arranged in tandem in the recess 8, they completely fill the recess to provide a substantially continuous and uniform level composite work surface at the work surface portion 3 (FIG. 3), whereas when the front block member 11 is omitted, an office machine 2 having a depending or entirely separate keyboard may be accommodated in the work station area 6 with the main portion thereof, e.g. a computer display tube section, resting on the rear block member 12 and with the depending or separate computer keyboard occupying the portion of the so-modified recess represented by the omitted front block member 11.

On the other hand, when both block members 11 and 12 are omitted, an office machine 2 of appropriate size and configuration may be situated fully within the recess at the selective height of the lower level of the recess area 9.

In this way, the deak 1 may be modified to accommodate different types of office machines which may be used at different times in the work station area 6, so that the machine operator seated at the desk will not tire from a keyboard in one case unduly high and in another case unduly low relative to the overall standard height of the desk, depending upon the configuration of the particular office machine in question, and at the same time will have an unobstructed work station area 6 available thereat, especially in terms of the unobstructed full and sufficient linear width of the front access edge 5 thereat.

Moreover, such recess and filler block arrangement will also permit different size and height individuals to use the same work surface area and office machine, appropriately adjusted relative to the individual office machine operator, for accommodating that individual thereat, and without the need necessarily to adjust the height of a chair or select a chair of appropriate height for that individual at desk 1 to conform the work area level and office machine level to the particular level of the individual seated at the desk 1.

Preferably, desk 1 comprises a center section 13 having a substantially rectangular center work surface portion 14 provided at the front side 4 with such front access edge 5, work station area 6, and recess 8, and a pair of left and right opposed diverging side sections 15 and 16 angularly disposed to each other, preferably at an angle of about 90 degrees, and to the center section, correspondingly at a respective angle of about 45 degrees. Each side section 15 and 16 has a corresponding, or more or less mirror image, substantially triangular side work surface portion 17 and 18 adjacent to the center work surface portion 14 (FIG. 2).

It will be seen that the legs 7 support the center section 13 and side sections 15 and 16 in the form of a tripartite free standing angular desk 1, correspondingly having sufficient linear width at the center work surface portion 14 to provide the stated unobstructed work station area 6 for the office machine operator, e.g. seated, at the front access edge 5 and vicinally between the adjacent confines of the side work surface portions 17 and 18 of the opposed diverging side sections 15 and 16 angularly disposed to the center section 13 and also to accommodate the office machine 2 in the work station area 6 at the recess 8 (FIG. 1).

The three sections 13, 15 and 16 may thus be constituted as individual and separate raised platforms and the legs 7 depending from appropriate peripheral portions of the center section 13 and side sections 15 and 16 may in turn be positioned so as to be substantially remote from the immediate confines of the front access edge 5, whereby the machine operator may sit at the desk 1 with plenty of unobstructed leg room beneath such platforms and to the lateral sides of the work station area range of center work surface portion 14.

A paper feed slot 19 is suitably defined in center work surface portion 14 rearwardly of recess 8, and has a sufficient slot length to accommodate the feeding of office machine paper (not shown) between a location in the interior of the desk 1 in the center section 13 below the center work surface portion 14 (not shown) and the location of the office machine 2 on the center work surface portion (FIG. 2). A hole 20 may be likewise defined in center work surface portion 14 rearwardly of feed slot 19 for an electric power cord for operating the office machine 2 or form a similar purpose, as the artisan will appreciate.

Advantageously, the side sections 15 and 16 may be preferably provided as individual raised platform pieces separate from each other and from the center section 13 which accordingly is also provided as an individual raised platform piece. Thus, the center work surface portion 14 rearwardly of the recess 8 has a pair of substantially parallel side abutment internal upper edges 21 and 22, an intermediate internal upper edge 23 facing the front access edge 5 and defining the upper level rearward limit of the recess 8, and a substantially converging composite rear corner external or peripheral upper edge 24 opposite to and remote from the front access edge 5 (FIG. 2).

In turn, the center work surface portion lower level recess area 9 has a corresponding pair of substantially parallel recess area side abutment internal lower edges 25 and 26 and a recess area intermediate internal lower edge 27 defining the lower level rearward limit of the recess area 9, with the front access edge 5 correspondingly defining the forward limit of the recess area, i.e. at front side 4 (FIG. 2).

The left and right side work surface portions 17 and 18, in complemental relation to the center work surface portion 14 and in more or less mirror image relation to each other, are correspondingly each provided with an angularly disposed substantially straight end abutment internal upper edge 28 and 29 in substantially coextensive facing relation to the adjacent side abutment internal upper edges 21 and 22 of the center work surface portion 14 and in substantially coextensive overlying facing relation to the adjacent recess area side abutment internal lower edges 25 and 26.

The side work surface portions 17 and 18 are also correspondingly each provided with substantially parallel angularly disposed external or peripheral upper front edges 30and 31 and upper rear edes 32 and 33, respectively, extending from the end abutment internal upper edges 28 and 29 in an angular direction away from the center work surface portion 14, as well as a substantially straght free end external or peripheral upper edge 34 and 35 remote from the center work surface portion 14, as the case may be (FIG. 2).

The upper level remainder of the center work surface portion 14 may be suitably connected to the recess area 9, e.g. constituted as a flat rectangular recess area floor or plate 36, by means of a vertical rear recess wall or supporting connector 37, e.g. constituted as a vertical depending flange at intermediate upper edge 23 extending forwardly under the rear end of plate 36 which corresponds to intermediate lower edge 27 (FIG. 3).

Likewise, the upper level side work surface portions 17 and 18 may be connected to the sides of recess area 9 by means of substantially parallel vertical side recess walls or carriers 38 and 39, e.g. constituted as vertical depending flanges attached at their upper end portions, e.g. by screws or the like, to the undersides of the side sections 15 and 16 at the end abutment upper edges 28 and 29 and extending medially under the sides of plate 36 which correspond to the side abutment lower edges 25 and 26 of recess area 9 (FIGS. 1 and 3).

Carriers 38 and 39 in essence constitute a portion of the mounting means which through the agency of the side sections 15 and 16 transmit the load of any office machine 2 in the recess area 9 to the legs 7 along with the remainder of such load transmitted via the supporting connector 37 and the remainder of the center work surface portion 14 through the agency of center section 13 to the legs 7 (FIG. 1). Connector 37 and carriers 38 and 39 along with plate 36 in effect constitute the surrounding boundary structure defining the confines of the recess area 9 of the peripherally intermediately disposed depression recess 8 in work surface portion 3 of the free standing desk 1 in which the block members 11 and 12 are interchangeably arranged, as desired.

A paper tray 40 may be optionally fixed to the underside of plate 36 rearwardly of front access edge 5, if desired (FIG. 1). Because of the ample leg room beneath the raised platform section free standing desk 1, such paper tray 40 will not interfere with normal access and usage of the desk.

It will be appreciated that the perimetric angular configuration of the desk 1 advantageously lends itself to positioning in a normal confined area corner portion of a room, rendering the same simple, space-saving and confined shaped space-adaptable in design and construction, while permitting unobstructed access to such free standing desk due to the unobstructed work station area provided and despite the confined shaped space represented by such confined area corner portion of the room.

Figure 4:
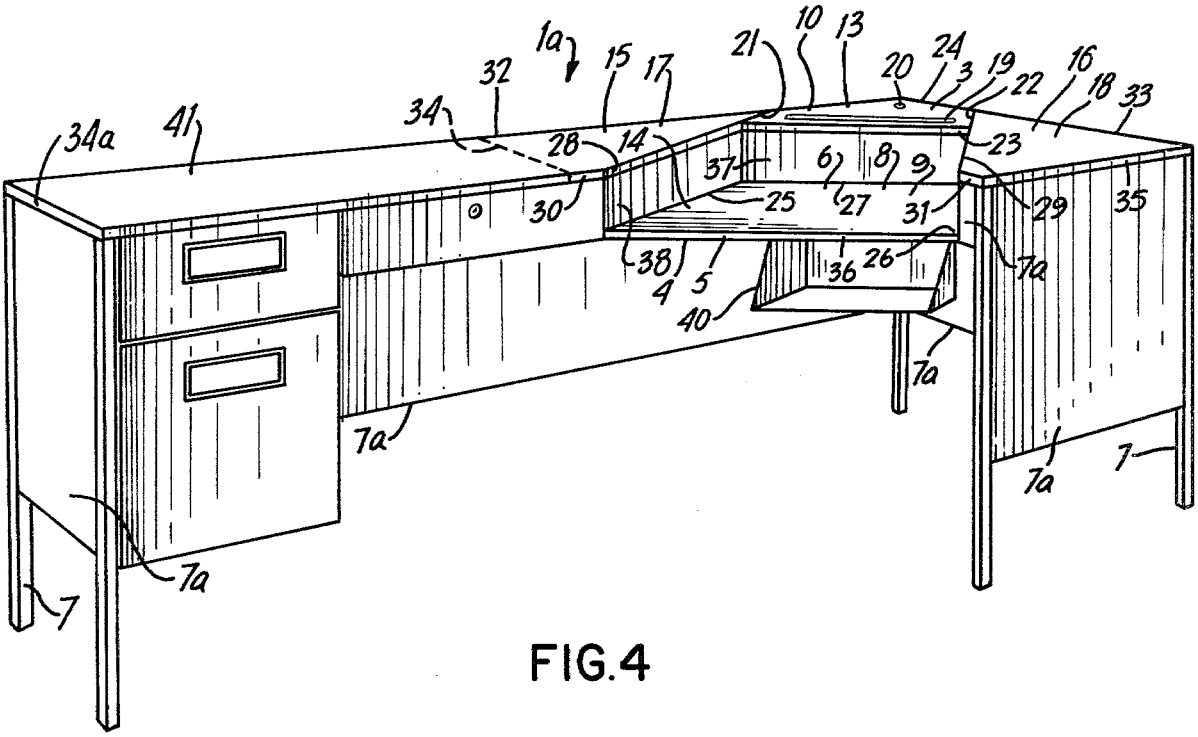
FIG. 4 is a schematic perspective view of another desk similar to that shown in FIG. 1 but modified to provide a single wing extension configuration.

FIG. 4 shows a modified form of a desk 1*a*, of like construction to desk 1 but provided with an extension wing 41 extending outwardly from side section 15 to form a lateral continuation thereof in an angular direction away from the center work surface portion 14, here shown with both of the block members 11 and 12 removed therefrom, and terminating in a substantially straight free end external or peripheral upper edge 34*a*, spaced laterally from the position or zone of upper end edge 34 shown schematically in the side work surface portion 17, and further remote from the center work surface portion 14.

Figure 5:
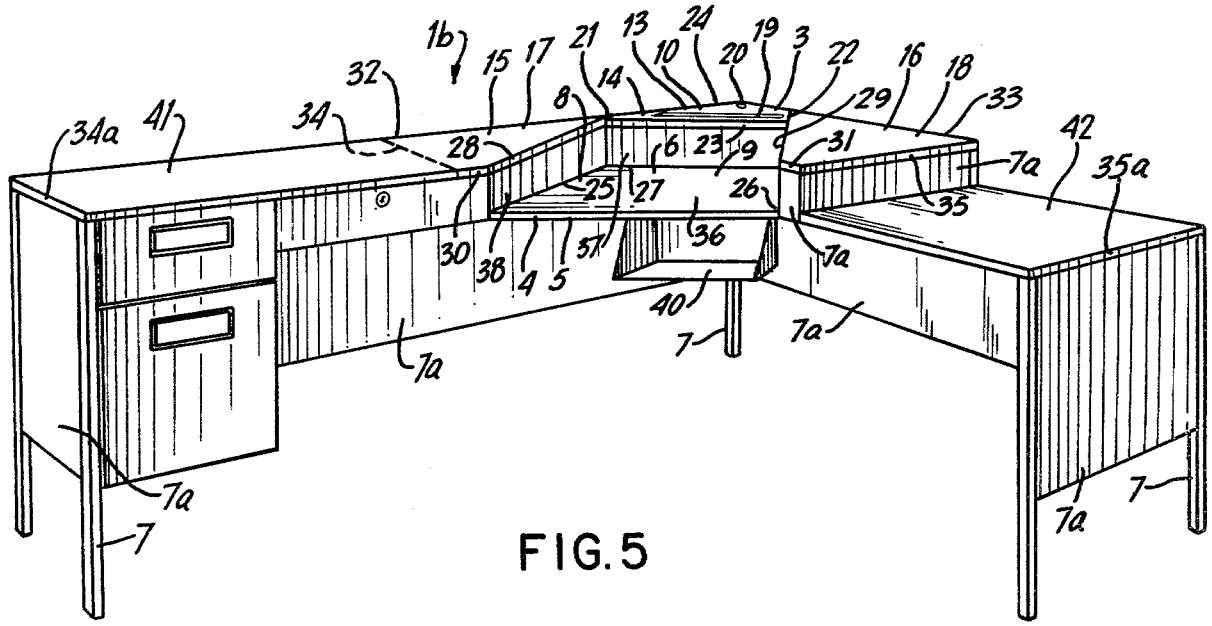
FIG. 5 is a schematic perspective view of a further desk similar to that shown in FIG. 1 but modified to provide a double wing extension configuration.

FIG. 5 shows a further modified form of a desk 1*b*, of like construction to desks 1 and 1*a* but provided as a bilateral wing type desk, i.e. with a further extension wing 42 extending outwardly from side section 16 to form a lateral continuation thereof selectively at a lower level and in an opposed angular direction away from the extension wing 41, the side section 15 and the center work surface portion 14, and terminating in a substantially straight free and external or peripheral lower edge 35*a*, spaced laterally from the zone or position of the end upper edge 35 in the side work surface portion 18, and further remote from the center work surface portion 14.

The arrangements of the modified desks 1*a* and 1*b* of FIGS. 4 and 5 illustrate, in the same way as desk 1 of FIGS. 1 to 3, that the mounting means, apart from appropriate frame and wall structure beneath and interiorly of the particular desk, e.g. at work surface portion 3, include a plurality of legs 7 which are conveniently selectively locatable peripherally or perimetrically outwardly of the work surface portion 3, and especially of the zonal area portions represented by the center section 13 and the side sections 15 and 16. These legs 7 are distributed in such manner as to be substantially remote from the immediate confines of the front access edge 5 for permitting ample leg room beneath and laterally of the front access edge 5 and the work station area 6 thereat to be achieved, while at the same time providing stable support for the free standing desk.

As the artisan will appreciate, the frame and wall structure *7a* beneath and interiorly of the desk and which forms a part of the mounting means, in addition to the legs 7 depending directly from the periphery of the center section 13 and side sections 15 and 16, includes as aforesaid the carriers 38 and 39 which hold the lower level rectangular plate 36 of depression recess 8 and which transmit any load thereon via the side sections 15 and 16 to the appropriately distributed spaced apart legs 7.

Where the center section 13 and the side sections 15 and 16 are each individually formed as a separate platform piece, the mounting means may desirably also include underside attachment straps or plates (not shown) interconnecting, e.g. by upwardly inserted removable screws or the like, in conventional manner the adjacent margins of these sections rearwardly of the depression recess 8, as the case may be.

Specifically, for instance, one such attachment strap or plate may be provided to span the underside adjacent margins of the center section 13 and the left side section 15 across the interface between the side abutment upper edge 21 and the adjacent portion of the end abutment upper edge 28 in coextensive facing relation thereto, and another such attachment strap or plate may be provided to span the underside adjacent margins of the center section 13 and the right side section 16 across the interface between the side abutment upper edge 22 and the adjacent portion of the end abutment upper edge 29 in coextensive facing relation thereto.

Desirably, such attachment straps or plates may in fact constitute continuation extension flange portions (see FIG. 3) of left and right carriers 38 and 39 rearwardly of the recess floor or plate 36 and located at the upper level portions of such carriers situated at the adjacent underside margins of the side sections 15 and 16 throughout the linear extent of the end abutment upper edges 28 and 29, and extending across the corresponding interface rearwardly of the depression recess 8 to the corresponding underside margins of center section 13 throughout the remainder of the side abutment edges 21 and 22, thereat, as the artisan will appreciate.

Hence, the resulting tripartite recess-containing desk may be disassembled and reassembled with ease, e.g. by removing the screws from such underside attachment straps or plates.

According to a versatile feature of the recess-containing embodiment of the desk as contemplated by the structure shown in FIGS. 1 to 3, 4 and 5, as the case may be, the filler means may comprise multiples of the front and rear block members 11 and 12 as shown in FIG. 3, including horizontally split level block members of individual reduced thickness or height stacked in superimposed aligned relation to one another, as shown schematically in FIG. 3, so that not only the front to rear area extent of the depression recess 8 may be modified by interchangeable arrangement of the block members but also the bottom to top level or height of the recess 8 itself may be compositely modified.

Thus, where block members 11 and 12 are formed as two separate correspondingly shaped flat block members of half of the thickness or height of the full block members 11 and 12 as shown in FIG. 3, the upper flat block members may be removed to provide an intermediate level composite depression recess defined by the remaining half height of the two lower flat block members situated in the recess 8, or the front lower flat block member may also be removed, leaving only the rear lower flat block member situated in recess 8 to provide a graduated stepped composite depression recess.

In this way, more versatile accommodation of differently shaped and sized office machines with varying height keyboard arrangements may be achieved as well as like accommodation of different size and height individual office machine operators.

If desired, aligned key means, such as conventional cooperating tongues and grooves or two or more bosses and boss depressions (not shown) may be provided in the opposed faces of the half height flat block members and in the face of plate 36 in the recess 8 itself, or on the undersides of the block members 11 and 12 and in the face of plate 36 in the recess 8, to lock the corresponding filler means in place against movement, e.g. forwardly outwardly of recess 8 in the direction of front access edge 5, during operation of the office machine 2, as the artisan will appreciate.

Thus, inherently the filler means or various block members are separate and discrete from, and thus unobstructed and unencumbered by, and disposed independently of, any office machine being accommodated in the work station area, and in turn are capable of and disposed for selectively self-positionable and independently self supporting removable insertion in the recess for cooperation therewith to modify correspondingly selectively the extent and configuration of the open recess area thereat in conformity with the corresponding extent and configuration of such an office machine being so accommodated, and also to provide thereby a correspondingly unobstructed and unencumbered composite work surface area at the work surface portion for so accommodating such office machine.

More specifically, as to the block members, at least two interchangeable cooperating unobstructed and unencumbered block members of selective individual shape and size are preferably provided, which together are inherently cooperatingly, and selectively positionably, removably insertable simultaneously in the recess to fill the lower level open recess area thereat at least partially to provide thereby a corresponding recess area modified unobstructed and unencumbered composite work surface at the work surface portion.

Figure 6:
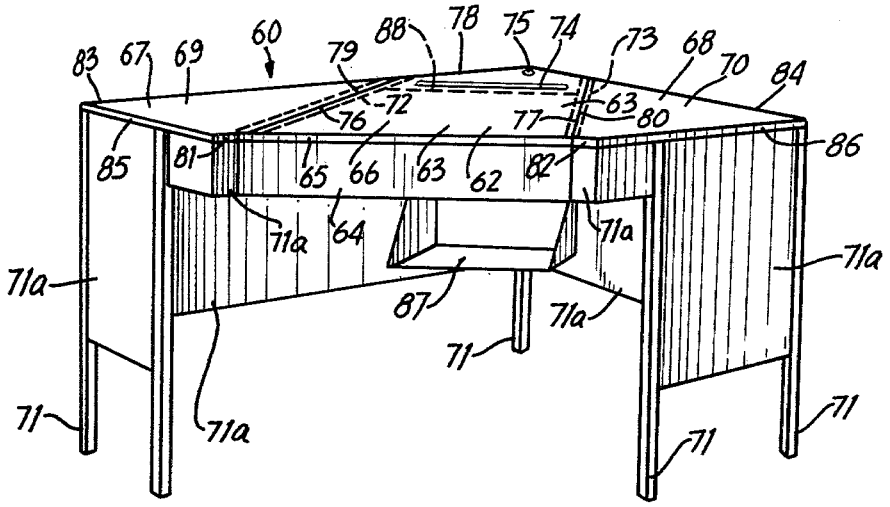
FIG. 6 is a schematic perspective view of a recess-free work station angular desk for an office machine such as a computer according to an alternative embodiment of the present invention having a front access edge of sufficient width to provide an unobstructed work station area and to accommodate such office machine thereat.
Figure 7:
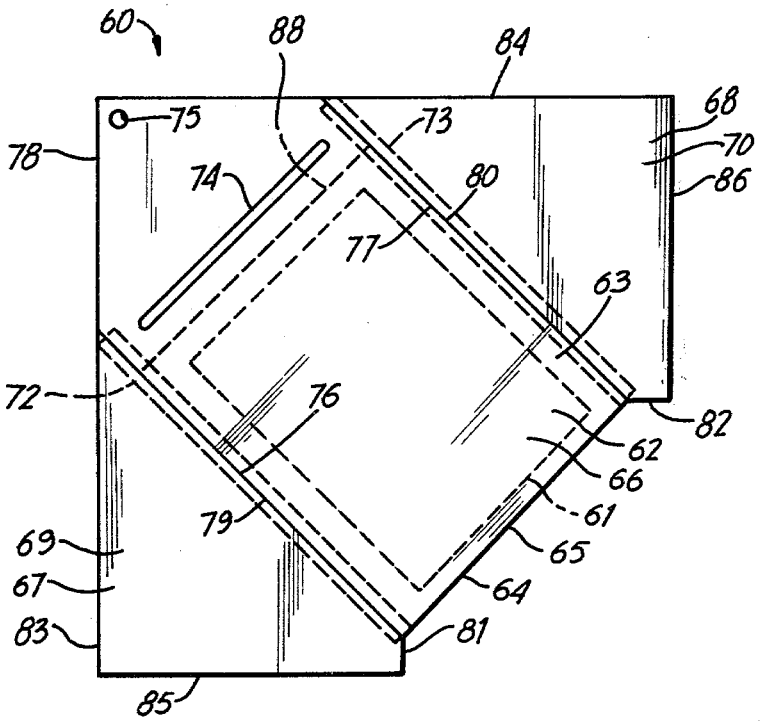
FIG. 7 is a schematic top view of the desk shown in FIG. 6.

In accordance with an alternative embodiment of the present invention, as shown in FIGS. 6 to 7, a tripartite work station recess-free angular desk 60 for an office machine such as the computer, schematically shown at 61, may be advantageously provided. Desk 60 comprises the individual center section 62 having a substantially rectangular individual center work surface portion 63 provided along its front side 64 with a substantially straight front access edge 65 of sufficient linear width relative to the width, e.g. from shoulder to shoulder as aforesaid, of an office machine operator (not shown) seated at the desk 60 to provide an unobstructed work station area 66 thereat and also to accommodate the office machine 61 therein.

Desk 60 further comprises a pair of left and right opposed diverging individual side sections 67 and 68 separate from and angularly disposed to each other and to the individual center section 62. The side sections 67 and 68 have corresponding substantially triangular individual left and right side work surface portions 69 and 70, respectively, separate from each other and adjacent to the center work surface portion 63.

Mounting means including legs 71 and left and right attachment straps or plates 72 and 73 on the undersides of the sections interconnect and support the center section 62 and the left and right side sections 67 and 68 in the form of a tripartite free standing angular desk 60, having a substantially continuous and uniform common level composite work surface and correspondingly having a sufficient width at the center work surface portion 63 to provide the desired unobstructed work station area 66 for the office machine operator situated at the front access edge 65 and vicinally between the adjacent confines of the left and right side work surface portions 69 and 70 of the opposed diverging side sections 67 and 68 angularly disposed to the center section 62 and also to accommodate the office machine 61 in the work station area 66.

The attachment straps or plates 72 and 73 may interconnect the sections by upwardly inserted removable screws or the like (not shown) in conventional manner, as the artisan will appreciate.

Desirably, here also vertical walls 71*a* may be provided to contribute vertical and lateral support between the legs 71 and a hollow box like structural configuration type mounting means for the desk 60.

In this way, the desk 60 is able to accommodate an office machine 61 such as a computer in the work station area 66 and at the same time provide an unobstructed work station area in terms of the unobstructed full and sufficient linear width of the front access edge 65 thereat, with ample leg room beneath the desk 60, avoiding any tiring of the operator of the machine, e.g. sitting at the desk in front of the office machine for prolonged periods of time as will necessarily otherwise occur at a computer readout terminal.

In this alternative recess-free angular desk embodiment, a paper feed slot 74 and electrical conduit hole 75, may be provided in center section 62 in a manner and for purposes corresponding to those for slot 19 and hole 20 in the recess-containing desk embodiments of FIGS. 1 to 3, 4 and 5, as the case may be, as the artisan will appreciate.

Preferably, the side sections 67 and 68 are angularly disposed at an angle of about 90 degrees to each other and correspondingly at an angle of about 45 degrees to the center section 62. Moreover, these three separate sections favorably may be formed as individual raised platforms at a composite common level or height. In turn, the mounting means, including the legs 71 and walls 71*a*, preferably depending from peripheral or perimetric boundary portions of the center section 62 and the side sections 67 and 68, as well as the attachment straps or plates 72 and 73 on the undersides of the three sections, may be conveniently located substantially remote from the immediate confines of the front access area 65.

Accordingly, the machine operator may sit at the desk 60 with plenty of unobstructed leg room beneath such raised platforms and to the sides of the work station area range of the center work surface portion 63.

It will be seen that the center work surface portion 63 has a pair of substantially parallel side abutment internal edges 76 and 77 and a substantially converging composite rear corner external or peripheral edge 78 opposite to and remote from the front access edge 65.

The side work surface portions 69 and 70, in complemental relation to the center work surface portion 63 and in more or less mirror image relation to each other, are correspondingly each provided with an angularly disposed substantially straight end abutment internal edge 79 and 80, respectively, in substantially coextensive facing relation to the adjacent side abutment internal edges 76 and 77 of the center work surface portion 63.

The side work surface portions 69 and 70 are also correspondingly each provided with substantially parallel angularly disposed external or peripheral front edges 81 and 82 and external or peripheral rear edges 83 and 84, respectively, extending from the end abutment internal edges 79 and 80 in an angular direction away from the center work surface portion 63, as well as with a substantially straight free end external or peripheral edge 85 and 86, respectively, remote from the center work surface portion 63, in appropriate lateral direction as the case may be.

A paper tray 87 may be optionally fixed to the underside of center section 62 rearwardly of the front access edge 65, if desired, in the same general manner and for the corresponding purposes as the paper tray 40 in connection with recess-containing desk embodiments according to FIGS. 1 to 3, 4 and 5, as the case may be.

It will be appreciated that here also the perimetric angular configuration of desk 60 advantageously lends itself to positioning in a normal confined area corner portion of a room, rendering the same simple, space-saving and confined shaped space-adaptable in design and construction, while permitting unobstructed access to such tripartitie raised platform free standing desk due to the unobstructed work station area provided and despite the confined shaped space represented by such confined area corner portion of the room.

The angular configuration of the recess-free desk 60 may be readily achieved using three individual pieces as the sections 62, 67 and 68, without the need to construct the same from one large piece of material of relatively great area. In fact, center section 62 may be formed of two complemental half pieces connected together along the abutment interface line shown schematically at 88 and interconnected on their undersides by a common underside attachment strap or plate (not shown), like plates 72 and 73, using upwardly inserted removable screws or the like, as aforesaid, to conserve material.

Hence, the resulting tripartite recess-free desk may likewise be disassembled and reassembled with ease, e.g. by removing the screws from such underside attachment straps or plates.

Figure 8:
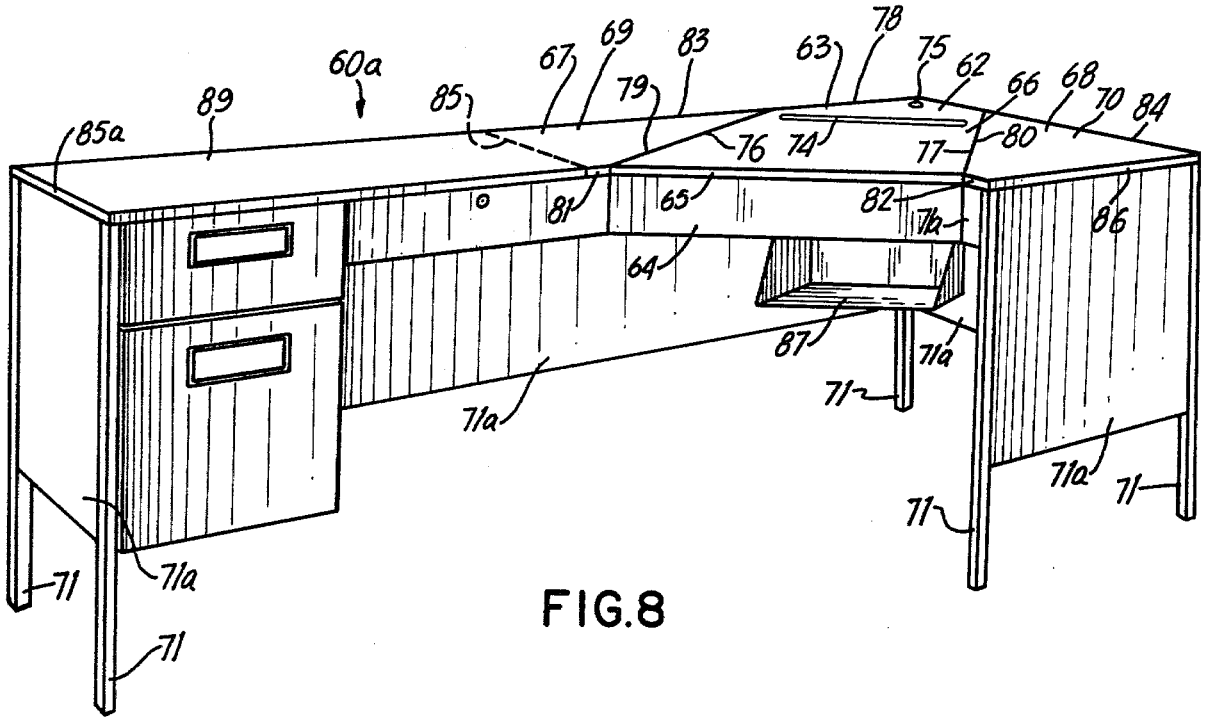
FIG. 8 is a schematic perspective view of another desk similar to that shown in FIG. 6 but modified to provide a single wing extension configuration.

FIG. 8 shows a modified form of a desk 60*a*, of like construction to desk 60 but provided with an extension wing 89 extending outwardly from side section 67 to form a lateral continuation thereof in an angular direction away from the center work surface portion 63 and terminating in a substantially straight free and external or peripheral edge 85*a*, spaced laterally from the position or zone of end edge 85 shown schematically in the side work surface portion 69, and further remote from the center work surface portion 63, in a manner similar to the recess-containing desk 1*a* shown in FIG. 4.

Figure 9:
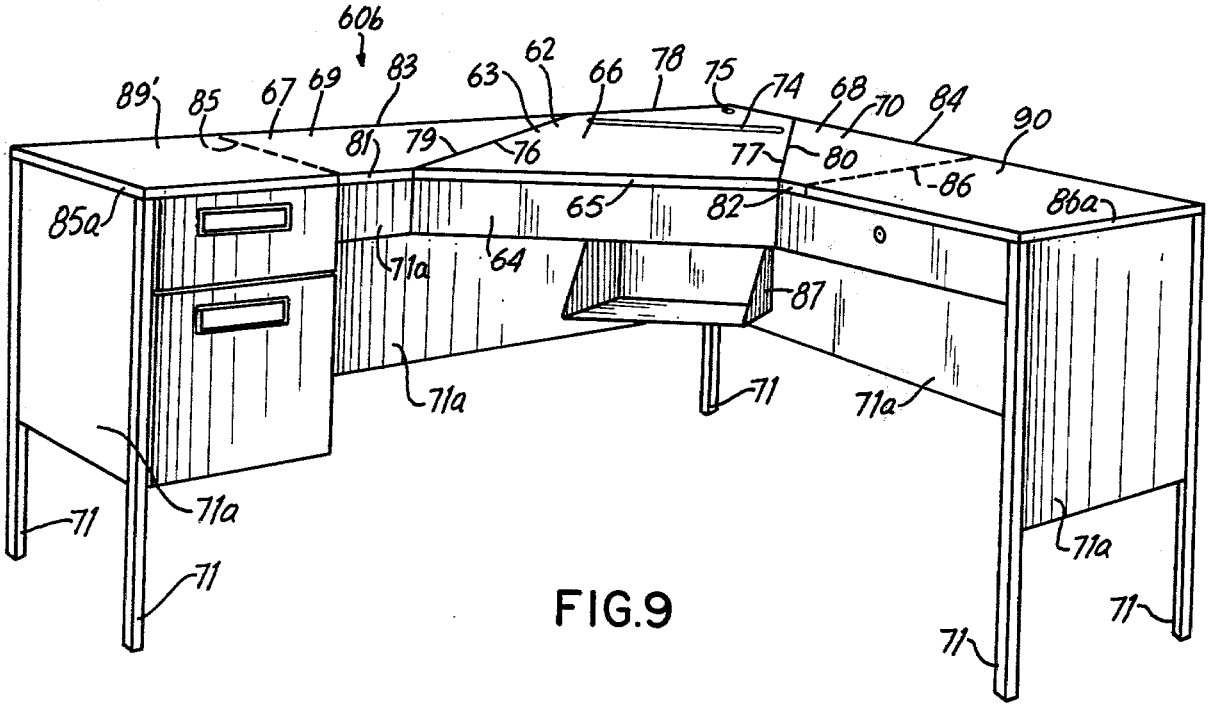
FIG. 9 is a schematic perspective view of a further desk similar to that shown in FIG. 6 but modified to provide a double wing extension configuration.

FIG. 9 shows a further modified form of a desk 60*b*, of like construction to desks 60 and 60*a* but provided as a bilateral wing type desk, i.e. with a modified extension wing 89' similar to extension wing 89 of desk 60*a* of FIG. 8 as well as with a further extension wing 90 extending outwardly from side section 68 to form a lateral continuation thereof in an opposed angular direction away from the modified extension wing 89', the side section 67 and the center work surface portion 63, and terminating in a substantially straight free end external or peripheral edge 86*a*, spaced laterally from the position or zone of end edge 86 shown schematically in the side work surface portion 70, and further remote from the center work surface portion 63.

The arrangements of the modified desks 60*a* and 60*b* of FIGS. 8 and 9 illustrate, in the same way as desk 60 of FIGS. 6 to 7, that the mounting means include a plurality of legs 71, and preferably also walls 71*a*, which are conveniently locatable peripherally or perimetrically outwardly of the work surface portions 63, 69 and 70 of sections 62, 67 and 68. These legs 71, and walls 71*a*, are distributed in such manner as to be substantially remote from the immediate confines of the front access edge 65 for permitting ample leg room beneath and laterally of the front access edge 65 and the work station area 66 thereat to be achieved while at the same time providing stable support for the free standing desk.

As the artisan will appreciate, the frame and wall structure 71*a* beneath and interiorly of the desk which forms a part of the mounting means, in addition to the legs 71 depending directly from the periphery of the center section 62 and side sections 67 and 68, include as aforesaid the underside attachment straps or plates 72 and 73 as well, which hold together the center work surface portion 63 and the side work surface portions 69 and 70 as a substantially continuous and uniform level composite work surface and which transmit any load on the center section 62 via the side sections 67 and 68 to the appropriately distributed spaced apart legs 71.

Such attachment straps or plates 72 and 73 in the embodiments of FIGS. 6 to 9, which interconnect the center section 62 and side sections 67 and 68, e.g. by upwardly inserted screws or the like, attaching the particular strap or plate to the underside margin of the adjacent section, illustrate the same type underside margin interconnecting strap or plate arrangement (not shown) which may be used as part of the mounting means in the embodiment of FIGS. 1 to 5, as the case may be, for interconnecting the center section 13 and the side sections 15 and 16, where such latter sections are also each individually formed as a separate platform piece in accordance with a particular modification as described above. This removable attachment construction per se facilitates the disassembling and reassembling of the sections for storing, transporting, etc. the desk in convenient manner.

It will be appreciated of course that while the respective single or double wing embodiments of FIGS. 4, 8 and 9 correspondingly show a common level for the overall desk work surface portion whereas the double wing embodiment of FIG. 5 shows a selectively lower level at one wing compared to the level of the remainder of the desk work surface portion, these various single and double wing extensions may in each instance as desired be provided at the same or at different selective levels relative to the main work station area and to each other.

Additionally, in all embodiments where the desk sections are formed as individual and separate raised platform pieces, e.g. as optionally provided in the embodiments of FIGS. 2, 4 and 5, and as especially provided in the embodiments of FIGS. 7, 8 and 9, as the case may be, advantageously all of the left side sections can be cut from a running length of the same planar board type construction material of selective width, e.g. by a 45 degree diagonal cut at one end and a 90 degree transverse cut at the other end in alternating cuts, and all of the right side sections can be cut from a separate length of such construction material in similar manner, whereas the center sections can be cut individually, one after the next, in appropriate manner from a third length of such construction material, and trimmed to form the composite rear corner edge, as the artisan will appreciate.

More specifically, a precursor piece may be cut by a 90 degree transverse cut from a length of the construction material in question in an additive longitudinal dimension represented by the combined length of upper rear edge 32 plus the length of upper front edge 30 of left side section 15 (FIG. 2) and by making a 45 degree diagonal cut intermediate its ends that piece may be formed into two corresponding left side sections 15 each having its end abutment upper edge 28 defined along such diagonal cut, with two corresponding right side sections 16 being formed in the same way from another such precursor piece but with the diagonal cut thereof in mirror image direction to that of the first piece.

The same process of cutting in alternative diagonal directions of cut in the given precursor piece will provide two corresponding left side sections 67 and two right side sections 68 (FIG. 7).

For accommodating the wing extension composite sections in the optional wing embodiments (FIGS. 4, 5, 8 and 9), the appropriate extended additive longitudinal dimension for the precursor piece will be selected, as the case may be.

Thus, multiples of two left side sections and multiples of two right side sections can be produced at the same time.

On the other hand, the center sections may be simply cut as individual precursor pieces from a running length of the planar construction material, and bilaterally trimmed at one end to provide the composite rear corner edge (FIG. 2) or 78 (FIG. 7), as the case may be.

Alternatively, to conserve even more material, the running width W of the planar construction material may correspond to twice the length of the side abutment upper edge 21 of center section 13 (FIG. 2) or of the side abutment edge 76 of center section 62 (FIG. 7), plus the resultant rearward length constituted by the height H of the corner edge 24 or 78 and by a series of appropriate concordant longitudinally spaced apart 90 degree transverse partial cuts laterally into the material at alternating opposed points from each side, and correspondingly 45 degree diagonal opposed partial cuts medially within the material at opposed points and communicating with the transverse partial cuts, successive individual laterally opposed center sections can be produced in offset manner.

More specifically, in this alternative center section cutting operation, it will be seen that in the embodiment of FIG. 2, the intermediate upper edge 23 for a given section 13 will be defined by the adjacent right lateral edge of the running length of the construction material and the side abutment upper edges 21 and 22 will be defined by two adjacent longitudinally spaced apart 90 degree transverse partial cuts laterally into the material from the adjacent right lateral edge, and that the 45 degree diagonal opposed partial cuts medially within the material thereat will define the composite rear corner upper edge 24 of such section 13, and at the same time (as shown in phantom in FIG. 2) will define one corresponding adjacent side portion of the mirror image opposed section 13 composite rear corner upper edge 24 in the next earlier section 13' and one corresponding adjacent side portion of the mirror image opposed section 13 composite rear corner upper edge 24 in the next later section 13" extending laterally inwardly from the opposite or left lateral edge of the running length of the construction material in staggered offset relation to the first-mentioned section 13.

Of course, the center sections 62 for the embodiment of FIG. 7 may be made in the same way as the sections 13, i.e. in opposed mirror image staggered offset relation, by appropriate transverse and diagonal cuts in a board or running length of construction material of requisite additive width corresponding to twice the length of the side edge 76 or 77 of the center section 62, plus the resultant rearward length constituted by the height of corner edge 78 whereby to conserve the construction material and minimize wastage, as the artisan will appreciate.

Advantageously, in accordance with the foregoing structural arrangements, the present invention provides simple and inexpensive solutions to adequate unobstructed access of an office machine operator to an office machine such as a computer at the work station area of a given desk, and to convenient modification of the work station area to conform the same to a particular office machine to be used thereat, and especially where the desk is an angular shaped desk lending itself to location in a confined space in a room, e.g. at a corner area of such room, and the office machine operator is normally intended to spend most or all of his or her entire working day seated at such desk.

In all of the contemplated structural arrangements of the present invention, the work station desk is provided with a front access edge of sufficient width relative to the width of the office machine operator situated thereat to permit an unobstructed work station area to be achieved and also to permit the versatile accommodation of any appropriate office machine in such work station area, while at the same time being provided with mounting means including legs situated substantially remote from the immediate confines of the front access edge of the desk and supporting the sections in the form of a free standing, preferably raised platform section, type desk.

As regards the recess-containing desk embodiments of FIGS. 1 to 5 in particular, the additional specific advantage is attained of providing means for modifying the work station area to conform the same to the conformity of a given appropriate office machine to be used thereat, e.g. a computer having two working levels comprising a computer display tube at eye level corresponding to the eye level of a person sitting at the desk front access edge and a computer keyboard at a lower level relative to the normal level or height of the desk, whereby appropriate adjustment of the filler means relative to the desk recess will change the configuration, extent, shape and height of the work station area, relative to the size and height of the particular individual sitting at the desk, and in turn of the size and height of the particular chair on which such individual is sitting, in cooperating dependence upon the configuration, extent, shape and height of the office machine, and in turn of the relative heights of its operational components such as a computer display tube and computer keyboard, for optimumly accommodating such office machine at the work station area of the desk.

In effect, the recess-containing desk according to the present invention provides filler means for concordantly adjusting the dimensional relationships in question to coordinate and reconcile, and thus versatilely accommodate, different sizes and heights of individuals, desk chairs and office machines for most efficient resultant cooperative effect.

As regards the recess-free desk embodiments of FIGS. 6 to 9 in particular, the additional specific advantage is attained of providing inexpensively separate individual selectively sized and shaped cooperating central and opposed side work surface sections, which are removably interconnected and supported inexpensively by mounting means, in the form of a readily disassembled and reassembled tripartite section free standing angular desk having a substantially continuous and uniform level composite work surface as well as a sufficient width at the center section, whereby to permit the desired unobstructed work station to be achieved for the individual seated at the front access edge and vicinally between the adjacent confines of the side sections, and also to permit versatile accommodation of the office machine, e.g. computer, in the work station area thereat.

In effect, the recess-free, angular free standing tripartite section, substantially continuous and uniform level composite work surface, wide front access edge and unobstructed work station area, desk, although extending over a relatively large overall composite horizontal surface area, is formed of relatively narrow running width individual and separate platform pieces more or less, or substantially, contiguously arranged with respect to each other to provide the desired angular offset configuration, and readily cut from appropriate lengths of conventional planar board or conventional composite manufactured planar board material of such relatively narrow running width in a manner inherently conserving wastage and utilizing to the maximum extent possible the planar board or planar board material as basic construction material (cf. FIG. 7), as the artisan will appreciate.

The various desk embodiments of the present invention are by their very nature and structure, as shown, simple as well as space-saving in design and construction, lending themselves to ready adaptation for use in confined shapes spaces such as confined corner wall areas of rooms. They are also inexpensive to produce as modular units from readily available materials, easily cut to modular size and shape with a minimum of effort and wastage and robust and durable in use.

As the artisan will appreciate, where the recess-containing desk is in the form of a tripartite desk formed of three individual sections, as in the case of the tripartite recess-free three individual section desk, the particular desk may be readily disassembled for storage, transporting the same from place to place and particularly, for negotiating passage through narrow spaces such as doorways and the like, and thereafter reassembled at the site of its end point of use, e.g. in a corner area of a room, with ease.

The relatively unobstructed access of the office machine operator to the office machine on the desk, even where the desk is situated in a confined space, such as a corner area of a room, permits unhindered activity to be carried out without aggravating the normal strain on the office machine operator sitting at the desk for prolonged periods of time, day in and day out, such as will occur more and more in the future as the prevalence of computers at computer readout terminals and like work station areas intensifies.

It will be appreciated that the foregoing specification and drawings are set forth by way of illustration and not limitation, and that various modifications and changes may be made therein without departing from the spirit and scope of the present invention which is to be limited solely by the scope of the appended claims.

What is claimed is:

1. Work station desk in the form of a work station angular desk for an office machine comprising a center section having a substantially rectangular center work surface portion provided along one side thereof constituted as a front side with a substantially straight front access edge of sufficient width relative to the width of an office machine operator to provide an unobstructed work station area thereat and to accommodate an office machine therein, a pair of opposed diverging side sections angularly disposed to each other and to the center section, each side section having a corresponding substantially triangular side work surface portion adjacent to the center work surface portion, a selectively shaped and sized office machine accommodating depression recess defined in the center work surface portion and extending forwardly peripherally to the front access edge to provide a lower level open recess area thereat relative to the level of the remainder of the center work surface portion, compositely complemental cooperating selectively shaped and sized structurally supporting depression recess modifying filler means for removable insertion in the recess and cooperating therwith to modify the extent and configuration of the open recess area thereat in conformity with the corresponding extent and configuration of an office machine being accommodated in the work station area, and mounting means supporting the center section and side sections in the form of a free standing angular desk correspondingly having a sufficient width at the center work surface portion to provide such unobstructed work station area for an office machine operator situated at the front access edge and vicinally between the adjacent confines of the side work surfaces of the opposed diverging side sections angularly disposed to the center section and to accommodate an office machine in the work station area at such recess.

2. Desk according to claim 1 wherein the filler means include at least two interchangeable block members.

3. Desk according to claim 2 wherein the block members include in tandem a rear block member and a front block member which together completely fill the recess to provide a substantially continuous and uniform level composite work surface at the center work surface portion.

4. Desk according to claim 1 wherein a paper feed slot is provided in the center work surface portion having a sufficient slot length to accommodate the feeding of office machine paper between a location in the center section below the center work surface portion and an office machine location on the center work surface portion.

5. Desk according to claim 1 wherein the side sections are angularly disposed at an angle of about 90 degrees to each other and correspondingly at an angle of about 45 degrees to the center section.

6. Desk according to claim 1 wherein the sections comprise raised platforms, and the mounting means include legs depending from peripheral portions of the center section and side sections relatively remote from the immediate confines of the front access edge and supporting the sections in the form of a free standing angular raised platform desk.

7. Desk according to claim 1 wherein an extension wing is outwardly provided on at least one of the side sections to form a continuation thereof in an angular direction away from the center work surface portion.

8. Desk according to claim 1 wherein the side sections are separate from each other and from the center section and are removably interconnected by the mounting means, the center work surface portion rearwardly of the recess is provided with a pair of substantially parallel side abutment edges, an intermediate edge facing the front access edge and defining the rearward limit of the recess and a substantially converging composite rear corner edge opposite to and remote from the front access edge, the center work surface portion lower level recess area is provided with a corresponding pair of substantially parallel recess area side abutment edges and a recess area intermediate edge defining the rearward limit of the recess area, with the front access edge defining the forward limit of the recess area, and each side work surface portion is correspondingly provided with an angularly disposed end abutment in substantially coextensive facing relation to the adjacent side abutment edge of the center work surface portion and substantially coextensive overlying facing relation to the adjacent recess area side abutment edge, substantially parallel front and rear angularly disposed edges extending from the end abutment edge in an angular direction away from the center work surface portion and a free end edge remote from the center work surface portion.

9. Desk according to claim 1 wherein the recess is substantially coextensive in width to the width of the front access edge and center work surface portion.

10. Work station angular desk for an office machine comprising an individual center section having a substantially rectangular center work surface portion provided along one side thereof constituted as a front side with a substantially straight front access edge of sufficient width relative to the width of an office machine operator to provide an unobstructed work station area thereat and to accommodate an office machine therein, a pair of opposed diverging individual side sections separate from and angularly disposed to each other and to the center section, each side section having a corresponding substantially triangular side work surface portion separate from and adjacent to the center work surface portion, and.

mounting means interconnecting and supporting the center section and side sections in the form of a free standing angular desk having a substantially continuous and uniform level composite work surface and correspondingly having a sufficient width at the center work surface portion to provide such unobstructed work station area for an office machine operator situated at the front access edge and vicinally between the adjacent confines of the side work surface portions of the opposed diverging side sections angularly disposed to the center section and to accommodate an office machine in the work station area.

11. Desk according to claim 10 wherein a paper feed slot is provided in the center work surface portion having a sufficient slot length to accommodate the feeding of office machine paper between a location in the center section below the center work surface portion and an office machine location on the center work surface portion.

12. Desk according to claim 10 wherein the side sections are angularly disposed at an angle of about 90 degrees to each other and correspondingly at an angle of about 45 degrees to the center section.

13. Desk according to claim 10 wherein the sections comprise raised platforms, and the mounting means include legs depending from peripheral portions of the center section and side sections relatively remote from the immediate confines of the front access edge and supporting the sections in the form of a free standing angular tripartite raised platform desk.

14. Desk according to claim 10 wherein an extension wing is outwardly provided on at least one of the side sections to form a continuation thereof in an angular direction away from the center work surface portion.

15. Desk according to claim 10 wherein the sections are removably interconnected by the mounting means, the center work surface portion is provided with a pair of substantially parallel side abutment edges and a substantially converging composite rear corner edge opposite to and remote from the front access edge, and each side work surface portion is correspondingly provided with an angularly disposed end abutment edge in substantially coextensive facing relation to the adjacent side abutment edge of the center work surface portion, substantially parallel front and rear angularly disposed edges extending from the end abutment edge in an angular direction away from the center work surface portion and a free end edge remote from the center work surface portion.

16. Work station desk for an office machine comprising a work surface portion provided along one side thereof constituted as a front side with a front access edge of sufficient width relative to the width of an office machine operator to provide an unobstructed work station area thereat and to accommodate an office machine therein, an office machine accommodating depression recess defined in the work surface portion and extending forwardly peripherally to the front access edge to provide a lower level open recess thereat relative to the level of the remainder of the work surface portion, and cooperating compositely complemental structurally supporting depression recess modifying filler means capable of and disposed for selectively self-positionable removable insertion in the recess and cooperating therewith to modify correspondingly selectively the extent and configuration of the open recess area thereat in conformity with the correspondingly extent and configuration of an office machine being accommodated in the work station area.

17. Desk according to claim 16 wherein the recess is defined intermediately in the work surface portion to provide a lower level open recess area thereat relative to the level of the surrounding lateral and rearward remainder of the work surface portion and is substantially coextensive in width to the width of the front access edge, and the work surface portion comprises a raised platform and including mounting means.

18. Work station desk for an office machine comprising a work surface portion provided along one side thereof constituted as a front side with a front access edge of sufficient width relative to the width of an office machine operator to provide an unobstructed work station area thereat and to accommodate office machine therein, an office machine accommodating depression recess defined in the work surface portion and extending forwardly peripherally to the front access edge to provide a lower level open recess area thereat relative to the level of the remainder of the work surface portion, and cooperating unobstructed and unencumbered compositely complemental structurally supporting depression recess modifying filler means, disposed independently of any office machine being accommodated in the work station area, and capable of and disposed for selectively self-positionable and independently self-supporting removable insertion in the recess and cooperating therewith to modify correspondingly selectively the extent and configuration of the open recess area thereat in conformity with the corresponding extent and configuration of such an office machine being accommodated in the work station area and to provide thereby a correspondingly unobstructed and unencumbered composite work surface at the work surface portion for accommodating such an office machine.

19. Work station desk for an office machine comprising a work surface portion provided along one side thereof constituted as a front side with a front access edge of sufficient width relative to the width of an office machine operator to provide an unobstructed work station area thereat and to accommodate an office machine therein, an office machine accommodating depression recess defined in the work surface portion and extending forwardly perpherally to the front access edge to provide a lower level upon recess area thereat relative to the level of the remainder of the work surface portion, and cooperating compositely complemental structurally supporting depression recess modifying filler means for removable insertion in the recess and cooperating therewith to modify the extent and configuration of the open recess area thereat in conformity with the corresponding extent and configuration of an office machine being accommodated in the work station area, wherein the filler means include at least two interchangeable cooperating block members of selective individual shape and size which together are cooperatingly selectively removably insertable simultaneously in the recess to fill the lower level open recess area thereat at least partially to provide thereby a corresponding recess area modified composite work surface at the work surface portion.

20. Work surface desk for an office machine comprising a work surface portion provided along one side thereof constituted as a front side with a front access edge of sufficient width relative to the width of an office machine operator to provide an unobstructed work station area thereat and to accommodate an office machine therein, an office machine accommodating depression recess defined in the work surface portion and extending forwardly peripherally to the front access edge to provide a lower level open recess area thereat relative to the level of the remainder of the work surface portion, and cooperating compositely complemental structurally supporting depression recess modifying filler means for removable insertion in the recess and cooperating therewith to modify the extent and configuration of the open recess area thereat in conformity with the corresponding extent and configuration of an office machine being accommodated in the work station area, wherein the filler means include at least two interchangeable block members, including in tendam a rear block member and a front block member which together completely fill the recess to provide a substantially continuous and uniform level composite work surface at the work surface portion.

* * * * *